US005460850A

United States Patent [19]

Schuppe et al.

[11] Patent Number: 5,460,850

[45] Date of Patent: Oct. 24, 1995

[54] HOLD-DOWN DEVICE IN APPARATUS FOR METALIZING INTERNAL SURFACES OF METAL BODIES

[75] Inventors: James L. Schuppe; David M. Kolaga, both of Milwaukee, Wis.

[73] Assignee: Inductametals Corporation, Chicago, Ill.

[21] Appl. No.: 252,065

[22] Filed: Jun. 1, 1994

Related U.S. Application Data

[63] Continuation of Ser. No. 802,367, Dec. 4, 1991, abandoned.

[51] Int. Cl.[6] ..... B05D 7/22

[52] U.S. Cl. ..... 427/183; 427/191; 427/231; 427/234; 118/318; 118/324; 118/DIG. 10; 414/431

[58] Field of Search ..... 414/431; 118/306, 118/308, 317, 318, 324, DIG. 10; 427/181, 183, 191, 194, 231, 234

[56] References Cited

U.S. PATENT DOCUMENTS

| | | | |
|---|---|---|---|
| 2,040,767 | 5/1936 | Dudley | 118/DIG. 10 |
| 3,245,824 | 4/1966 | Treat et al. | 427/181 |
| 4,252,039 | 2/1981 | Wittler et al. | 414/431 |
| 5,059,453 | 10/1991 | Bernsten, Jr. | 427/231 |

*Primary Examiner*—Shrive Beck
*Assistant Examiner*—Katherine A. Bareford
*Attorney, Agent, or Firm*—Dick and Harris

[57] ABSTRACT

Apparatus for internally coating a pipe, comprising means heating a pipe as it is internally spray coated, a plurality of first rollers mounted on a first rotatable shaft having an inlet end proximate the heating means and an outlet end spaced from the heating means, and a plurality of second rollers mounted on a second rotatable shaft parallel to the first shaft and having an inlet end adjacent the heating means. Each second roller is spaced from and adjacent to a corresponding first roller in a paired relationship to thereby define a nesting groove located above the gap between each set of paired rollers. Motive means rotates the shafts and the mounted rollers to rotate the pipe within the nesting grooves of adjacent pairs of rollers. Advancing means longitudinally advances the pipe through the heating means and sequentially along the nesting grooves of adjacent pairs of rollers. Hold-down means is provided to maintain the hot rotating pipe within the sequence of nesting grooves adjacent the inlet end and along the inlet portion of the shafts to compensate for thermal expansion and contraction of the rotating pipe longitudinally advancing from the heating means into sequential nesting grooves of adjacent pairs of rollers, so that vibration of the advancing pipe is eliminated and a uniform internal coating is produced.

6 Claims, 2 Drawing Sheets

D
20
21
22
23
24
25
26
28
29
30
31
32
33
34
35
36
37
38
39
42
42E
43
44
45
46
47
48
49
50
52
53

HOLD-DOWN DEVICE IN APPARATUS FOR METALIZING INTERNAL SURFACES OF METAL BODIES

This application is a continuation of application Ser. No. 07/802,367 filed Dec. 4, 1991, now abandoned.

FIELD OF THE INVENTION

The present invention relates to the metalizing of the interior of tubular metal bodies, such as pipes and tubes. In particular, the present invention relates to method and apparatus for metalizing the interior surface of tubular bodies with corrosion resistant and abrasion resistant metals to produce interiorly metalized articles, such as chrome plated pipes, tubes, and segments thereof. More particularly, the present invention relates to a hold-down device for use in an apparatus for metalizing the interior surfaces of tubular products.

BACKGROUND OF THE INVENTION

There are many fields of manufacture in which the interior of a base body, such as a pipe or tube, or a segment thereof, is metalized over an ordinary metal such as steel with an expensive surface layer treatment or coating that is fused to the base metal in order to provide a finished product that will respond to manufacturing specifications, but which is less expensive than making the entire body of the same material that the coating specifications require. Thus, parts such as the interior of pipes or tubes used to convey corrosive or abrasive fluids, liquids, slurries and the like, are frequently required to provide thereon an interior metalized surface of chromium, or chrome, or other special metal or metal alloy, that will either resist corrosion and wear or will provide a good bearing surface. In strings of pipe used in deep oil wells, for example, it is desirable that the interior surface of the pipe have resistance to corrosion and wear, so as to extend the time period during which a string of pipe will function before corrosion or abrasive failure causes disruption of oil production and consequent increase of costs. Similarly, strings of pipe which are used to transport concrete slurry from a source of supply to the site of use, must have a wear resistant inner surface in order to withstand the abrasion of the inner surface which is caused by the aggregate (sand, gravel, and crushed stone) which is mixed with the cement in the concrete slurry.

It has been long known that ordinary steels, except for leaded steels or resulphurized steels, may be chrome surfaced by plating or the like, to meet the specifications for desired strength of the part and provide the surface character specially required for exposure to a harsh environment in which the part is to be used.

However, chromium, for example, is a relatively expensive material, and the use of chromium in various chemical baths by which chrome plating may be effected, is environmentally undesirable, operationally difficult and expensive to control. Also, it is technically difficult to deposit a metalizing layer of any substantial thickness onto the interior surface of tubes or pipes, or segments thereof, that are to serve as the bearing surface of a bearing or journal element. Moreover, the deposition of thin layers of coating metals upon the inside surface of pipes and tubes has been extremely difficult when the pipe or tube has a small diameter, such as for nominal pipe sizes of about three inches or less.

In order to avoid such potential problems, a coating apparatus has been recently fabricated and operated which comprises a plurality of first rotatable rollers mounted on a first rotatable shaft having an inlet end and an outlet end, and a plurality of second rotatable rollers mounted on a second rotatable shaft having an inlet end adjacent the inlet end of the first rotatable shaft, and having an outlet end adjacent the outlet end of the first rotatable shaft. Each second roller is spaced from and adjacent to a corresponding first roller in a paired relationship to thereby define a gap of fixed dimension between each pair of adjacent first and second rollers.

A heating means which is operable to melt and fuse a powdered metal coating to the inside surface of a rotating pipe is located proximate the outlet ends of the first and second shafts.

A plurality of third rollers mounted on a third rotatable shaft having an inlet end proximate the heating apparatus and having an outlet end spaced from the heating apparatus is paired on the discharge side of the heating apparatus with a plurality of fourth rollers mounted on a fourth rotatable shaft having an inlet end adjacent the inlet end of the third rotatable shaft, and having an outlet end adjacent the outlet end of the third rotatable shaft. Each fourth roller is spaced from and adjacent to a corresponding third roller in a paired relationship to thereby define a gap of the fixed dimension between each pair of adjacent third and fourth rollers.

A nesting groove is located above the gap between each pair of rotatable rollers and between the adjacent portion of the upper surfaces of each pair of rotatable rollers. This nesting groove provides horizontal support for an elongated tubular body, such as a pipe or tube, which is to be internally coated with metal.

A first motive means is utilized for rotating the first and second rotatable shafts and the mounted first and second rollers to thereby rotate the elongated tubular body within the nesting grooves of adjacent pairs of first and second rollers, and a second motive means is utilized for rotating the third and fourth rotatable shafts and the mounted third and fourth rollers to thereby rotate the elongated tubular body within the nesting grooves of the adjacent pairs of the third and fourth rollers.

A separate individual axial advancing means is used for longitudinally advancing the rotating elongated tubular body sequentially along the nesting grooves between adjacent pairs of first and second rollers, through the heating means, and sequentially along the nesting grooves between adjacent pairs of third and fourth rollers. Finally, the means for internally coating the elongated tubular body is a spray head which is located within the heating element for depositing the particulate coating material on the inside surface of the pipe.

While this novel apparatus has been successful in eliminating many of the problems which may have been encountered by use of the prior art techniques, a new and different problem has been encountered with the novel apparatus. It has been found that as the heated rotating pipe is discharged from the heating means, there is an occasional problem which arises due to vibration of the hot pipe advancing along the sequence of nesting grooves between the third and fourth rollers on the discharge side of the heating unit. This vibration occasionally becomes so intense that the rotating hot pipe may eventually vibrate sufficiently to fly off of the array of third and fourth rollers and onto the floor. Occasionally, the vibrating pipe may touch the induction heating coil which is located within the heating means and short-out the heater, thereby causing premature shutdown of the entire operating unit.

Accordingly, it is an object of the present invention to provide a method and apparatus for internally coating a metal tube or pipe without encountering excessive vibration of the tube or pipe as it is withdrawn from the heating apparatus and cooled while rotating and longitudinally advancing along the sequence of nesting grooves between the adjacent pairs of third and fourth rollers in the coating apparatus.

It is another object of the present invention to provide a method and apparatus for internally coating a metal pipe or tube without encountering vibration of the tube or pipe as it is withdrawn from the heating apparatus which is sufficient to cause the tube or pipe to be thrown out of the nesting grooves between the pairs of third and fourth rollers and onto the floor of the plant.

It is a further object of the present invention to provide a method and apparatus for internally coating a metal tube or pipe without vibration which is sufficient to cause the rotating and longitudinally advancing metal tube or pipe to touch the electrical elements of the heating unit and thereby cause a short circuit which shuts down the entire coating system.

These and other objects of the present invention, as well as the advantages thereof, will become more clear to those skilled in the art from the disclosure which follows.

SUMMARY OF THE INVENTION

It has been discovered that as the rotating pipe or tube is passed axially out of the heating apparatus and sequentially along the nesting grooves between adjacent pairs of rollers on the outlet side of the heating apparatus, the rotating pipe thermally expands rapidly, then thermally contracts less rapidly, and finally contracts slowly. Since the gap between adjacent pairs of rollers is a fixed dimension, the size and the shape of the sequence of nesting grooves on the outlet of the heating unit is constant. Therefore, the bottom of the rotating axially advancing heated pipe is dimensionally constrained against uniform thermal expansion and contraction by the fixed dimensions of the sequence of nesting grooves.

Accordingly, it has now become recognized that this constraint against uniform thermal expansion and uniform contraction causes the hot internally coated pipe to become "out-of-round" so that its cross-section near the heating unit is no longer circular, but is ovoid or egg-shaped. It has been determined that it is this irregular cross-section which causes the axially advancing hot pipe to vibrate within the sequence of nesting grooves as it rotates, thereby causing the pipe to occasionally spin out of the nesting grooves and onto the floor, or to occasionally bounce against an electrical heating element and short-out the internal coating apparatus.

Therefore, the present invention provides method and apparatus concepts which make allowance for the thermal expansion and contraction of the rotating pipe or tube as it is passed axially out of the heating apparatus and sequentially along the nesting grooves between adjacent pairs of outlet rollers, so that the rotating hot pipe or tube may not become out-of-round as it advances sequentially along the nesting grooves of adjacent pairs of rollers. In any event, the vibration of the rotating hot pipe or tube is controlled and even eliminated.

This is accomplished by using a hold-down device to control the vibration of the rotating hot pipe as it leaves the heating unit and advances sequentially along and within the nesting grooves of the paired rollers on the outlet side of the heating unit. The hold-down device pins or otherwise secures the hot rotating pipe within the nesting grooves to dampen, and even eliminate, vibration of the pipe within the nesting grooves.

By the use of the hold-down device, not only are the previously identified problems of bouncing on the floor and shorting out the electrical heater eliminated, but it has also been found that the hold-down device keeps the pipe "in-round" with no elliptical or ovoid cross-section. Additionally, the pipe is kept from bowing longitudinally with a permanent set. Moreover, it has been most surprisingly discovered that by eliminating vibration, the internal spray coating of powdered metal fuses into a finished internal coating which has a more uniform thickness.

Accordingly, in its apparatus aspects, one embodiment of the present invention comprehends an apparatus for receiving a heated cylindrical body from a heating means, where the apparatus comprises a heating means for heating the cylindrical body passing therethrough, a plurality of first rollers mounted on a first rotatable shaft having an inlet end proximate the heating means and an outlet end spaced from the heating means, and a plurality of second rollers mounted on a second rotatable shaft having an inlet end adjacent the heating means and the inlet end of the first rotatable shaft, and having an outlet end adjacent the outlet end of the first rotatable shaft, with each second roller being spaced from and adjacent to a corresponding first roller in a paired relationship. A nesting groove is located above each set of paired rollers and between the adjacent portion of the upper surfaces of each set of paired rollers. Motive means is provided for rotating the first and second rotatable shafts and the mounted first and second rollers to thereby rotate the cylindrical body within the nesting grooves of adjacent pairs of rollers. An axial advancing means is also provided for longitudinally advancing the rotating cylindrical body through the heating means and sequentially along and within the nesting grooves of the adjacent pairs of first and second rollers. Finally, the apparatus includes a hold-down means for maintaining a longitudinally advancing rotating elongated cylindrical body within the nesting grooves of the adjacent pairs of first and second rollers, as the rotating cylindrical body is advanced through the heating means and sequentially along and within the nesting grooves of adjacent first and second rollers.

In another embodiment, the present invention comprehends a coating apparatus for coating the inside surface of an elongated tubular body which comprises a plurality of first rollers mounted on a first rotatable shaft having an inlet end and an outlet end, and a plurality of second rollers mounted on a second rotatable shaft having an inlet end adjacent inlet end of the first rotatable shaft, and having an outlet end adjacent the outlet end of the first rotatable shaft, with each second roller being spaced from and adjacent to a corresponding first roller in a paired relationship to thereby define a gap of fixed dimension between the paired first and second rollers. A heating means is provided proximate the outlet ends of the first and second shafts for heating an elongated tubular body passing therethrough. A plurality of third rollers mounted on a third rotatable shaft having an inlet end approximate the heating means and an outlet end spaced from the heating means is further provided, and a plurality of fourth rollers is provided which is mounted on fourth rotatable shaft having an inlet end adjacent the heating means and adjacent the inlet end of the third rotatable shaft, and having an outlet end adjacent the outlet end of the third rotatable shaft, with each fourth roller being spaced from and adjacent to a corresponding third roller in a paired relationship to thereby define a gap between paired third and fourth rollers. A nesting groove is thereby provided above the gap between each set of paired rollers and between the adjacent portion of the upper surfaces of each set of paired rollers, within which a rotating tubular body may be supported. Motive means is provided for rotating the first and second rotatable shafts and the mounted first and second rollers to thereby rotate an elongated tubular body within the nesting grooves of the adjacent pairs of first and second rollers. Motive means is also provided for rotating the third and fourth rotatable shafts with the mounted third and fourth rollers to thereby rotate an elongated tubular body within the nesting grooves of the adjacent pairs of third and fourth rollers. The apparatus further includes an axial advancing means for longitudinally advancing the rotating elongated tubular body sequentially along and within the nesting grooves of adjacent pairs of first and second rollers, through the heating means, and sequentially along and within the nesting grooves of adjacent pairs of third and fourth rollers. A coating means is also provided for internally coating the elongated tubular body which is passing through the heating means. Finally, the apparatus includes a hold-down means for maintaining a longitudinally advancing rotating elongated tubular body within the nesting grooves of adjacent pairs of third and fourth rollers as the rotating tubular body is advanced through the heating means and sequentially along and within the nesting grooves of the adjacent third and fourth rollers.

In one preferred embodiment, the hold-down means of the coating apparatus comprises a rotatable hold-down roller in tangential contact with the rotating tubular body as the body advances along and within the nesting grooves of adjacent pairs of third and fourth rollers. In another preferred embodiment, the hold-down means includes a plurality of rotatable hold-down rollers in tangential contact with the rotating tubular body as the body advances along and within the nesting grooves of the adjacent pairs of third and fourth rollers. Additionally, the hold-down means may further include a plurality of rotating hold-down rollers in tangential contact with the rotatable tubular body as it is passed along the sequence of nesting grooves of adjacent pairs of first and second rollers towards and through the heating means. Further, the hold-down means preferably includes motive means for advancing the hold-down rollers toward the rotatable rollers for tangentially contacting the rotating tubular body, and for withdrawing the hold-down rollers away from the rotatable rollers which support the rotating tubular body.

Moreover, the present invention comprehends the methods which are involved in operating the various embodiments of the apparatus inventions.

A clearer understanding of the present invention will be obtained from the disclosure which follows when read in light of the accompanying drawings.

DESCRIPTION OF THE PREFERRED EMBODIMENTS

Figures 1, 2, 3, 4, 5:
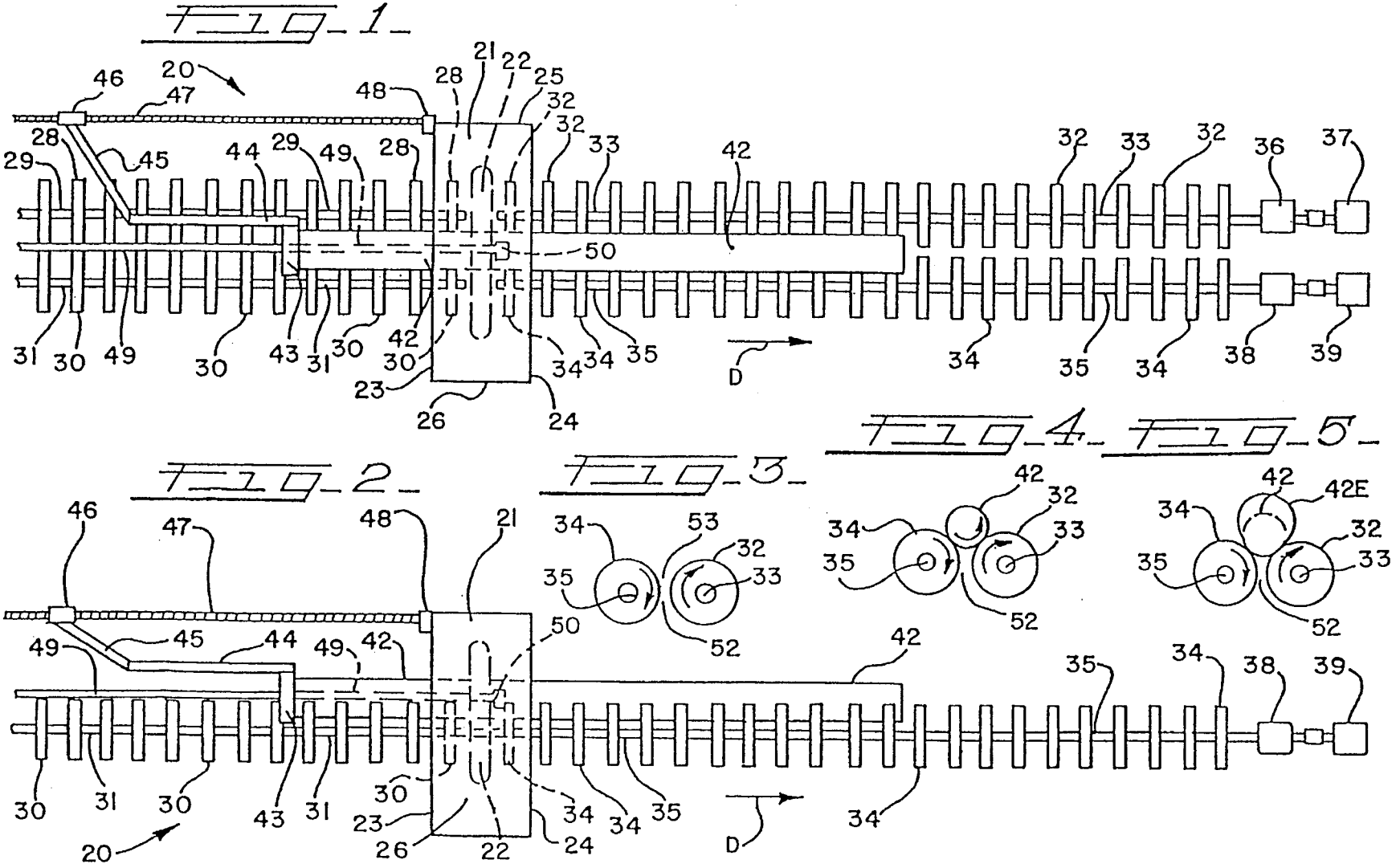
FIG. 1 is a simplified schematic representation, in plan view, of an apparatus for spray coating the interior surface of a rotating longitudinally advancing pipe or tube in accordance with the present invention.
FIG. 2 is a simplified schematic representation of the apparatus of FIG. 1, presented in a left side elevational view.
FIG. 3 is a simplified schematic representation, shown as an end view, of a pair of rotating rollers on the outlet side of the apparatus of FIGS. 1 and 2.
FIG. 4 is a simplified schematic representation of the paired outlet rollers of FIG. 3, but showing a pipe or tube rotating within the nesting groove between the rotating paired outlet rollers.
FIG. 5 is a simplified schematic representation of the paired outlet rollers of FIG. 4, but showing the maximum circumferential distortion of the pipe or tube due to thermal expansion as it rotates within the nesting groove between the rotating paired outlet rollers.

Referring now to FIGS. 1 and 2, there is shown a metal coating apparatus 20 in accordance with the present invention. The apparatus 20 includes an induction heating device 21 which contains a generally circular induction coil 22 having one or more circular windings. The induction heating device has a housing which includes an inlet side 23, an outlet side 24, a right side 25, and a left side 26. On the inlet side of the induction heater device there is located a plurality of right inlet rollers 28 mounted on a rotatable right inlet roller shaft 29, and a plurality of left inlet rollers 30 mounted on a rotatable left inlet roller shaft 31. On the outlet side of the induction heating device 21 there is a plurality of right outlet rollers 32 mounted on a rotatable right outlet roller shaft 33, and a plurality of left outlet rollers 34 mounted on a rotatable left outlet roller shaft 35.

At the far end of the rotatable shaft 33 is a right outlet roller variable speed transmission 36 which is coupled to shaft 33 on one side and to a right outlet roller electrical drive motor 37 on the other side. At the far end of the left outlet roller shaft 35 is a left outlet roller variable speed transmission device 38 which is coupled to shaft 35 on one side and to a left outlet roller electrical drive motor 39 on the other side. In an alternate embodiment, not shown, the variable speed transmission devices 36 and 38 may be eliminated by providing that the right outlet roller electrical drive motor 37 and the left outlet roller electrical drive motor 39 are each coupled directly to the outlet roller shafts 33 and 35, respectively, in which case both drive motors are variable speed motors. Equivalent motive means are coupled at the inlet ends of inlet roller shafts 29 and 31, but they are not shown in the drawings since they are to the far left of FIGS. 1 and 2. In any event, all motive means are operatively coupled to conventional control means which rotate the roller drive shafts 29, 31, 33 and 35 in unison in a manner sufficient to provide that a rotating elongated tubular body passing from the first and second inlet rollers 28 and 30 and through the heater 21 will continue to rotate at the same speed and in the same direction as it enters upon the outlet rollers 32 and 34.

It will be recognized that FIGS. 1 and 2 are simplified schematic representations of the apparatus configuration. Various standard elements of the machine, such as the machine frame with supporting brackets, pedestals, bearings, thrust bearings, and the like have been omitted from FIGS. 1 and 2 for purposes of clarity. Similar omissions are made in FIGS. 3 through 8 for the same purpose.

It is also to be noted that FIG. 2 illustrates an alternate structure for the coating apparatus 20, since the rotatable inlet shaft 31 and the rotatable outlet shaft 35 are shown to be two sections of a single common shaft. While FIG. 1 shows shafts 31 and 35 to be separated at the heating coil 22, FIG. 2 shows the shafts to be merged as a common shaft within heating coil 22. Alternatively, shafts 31 and 35 may be joined by a conventional shaft coupling within the coil 22 or elsewhere, and the shafts 31 and 35 could consist of four or more shaft segments coupled together. Such alternate arrangements have the advantage of reducing the number of transmissions and motors required to rotate the rollers 28, 30, 32 and 34.

FIGS. 1 and 2 show a cylindrical tube or pipe 42 which is rotating within the nesting grooves between the rotating paired rollers in the bed of the plurality of rollers hereinabove described. This can be more readily understood by referring now to FIGS. 3 and 4. In FIG. 3 there is shown an opposing pair of rotating outlet rollers 32 and 34, which are rotating upon their rotatable shafts 33 and 35, respectively. The opposing outlet rollers 32 and 34 are spaced apart to provide a gap 52 between the right outlet roller 32 and the left outlet roller 34. Above the gap 52 is a nesting groove 53 for the pipe 42, which can be positioned within the nesting groove 53 upon the rotating adjacent upper surfaces of the outlet rollers 32 and 34, as more clearly seen in FIG. 4.

As the cylindrical tube or pipe 42 is rotated within the nesting grooves 53 of the array of rollers, it is also advanced longitudinally within the sequence of nesting grooves between the paired rollers by means of a pusher unit, as shown by the directional arrow D in FIGS. 1 and 2. The pusher unit includes a pusher pad 43 which is held against the rear end of the pipe or tube 42. The pusher pad has an annular configuration for holding the rotating end of pipe 42, and it is attached to an elongated forearm 44, which in turn is attached to an angled upper arm 45, which terminates in a shoulder element 46. Shoulder element 46 contains a bore which has a helical inside thread in mating relationship with a helical screw thread on a reversibly rotatable drive shaft 47. The helical screw drive shaft 47 is driven by a motive means, not shown, which is attached to the end of the drive shaft 47 to the far left of FIGS. 1 and 2. The right end of the helical screw drive shaft 47 terminates in an end mount 48 which includes a thrust bearing.

A powdered metal feed line 49 extends above the plurality of rotating right inlet rollers 28 and left inlet rollers 30 and over the plurality of nesting grooves therebetween. Feed line 49 passes through a central opening in the annular pusher pad 43, and it enters the trailing end of the longitudinally moving pipe or tube 42. The powdered metal feed line 49 conveys a suspension of powdered metal in a non-oxidizing gas, such as nitrogen, helium, or argon, and it is supplied from a conventional source which is not shown since it is to the far left in FIGS. 1 and 2. The powdered metal suspension is sprayed onto the inside surface of the rotating pipe or tube 42 by means of a spray nozzle 50 located within the induction heating apparatus 21. It will be noted that as the pipe 42 advances longitudinally in the sequence of nesting grooves between the array of inlet rollers, it passes over and encompasses the feed line 49 and spray nozzle 50. As it moves through the induction heating coil 22, thermal excitation of the pipe metal and the sprayed powdered coating metal occurs, so that the powdered metal sprayed on the inside surface of the pipe 42 becomes melted, evenly distributed on the inner surface of pipe 42 by the rotation of the pipe 42, and then fused to the inside surface of the pipe 42 in a uniform thin layer.

Figure 6:
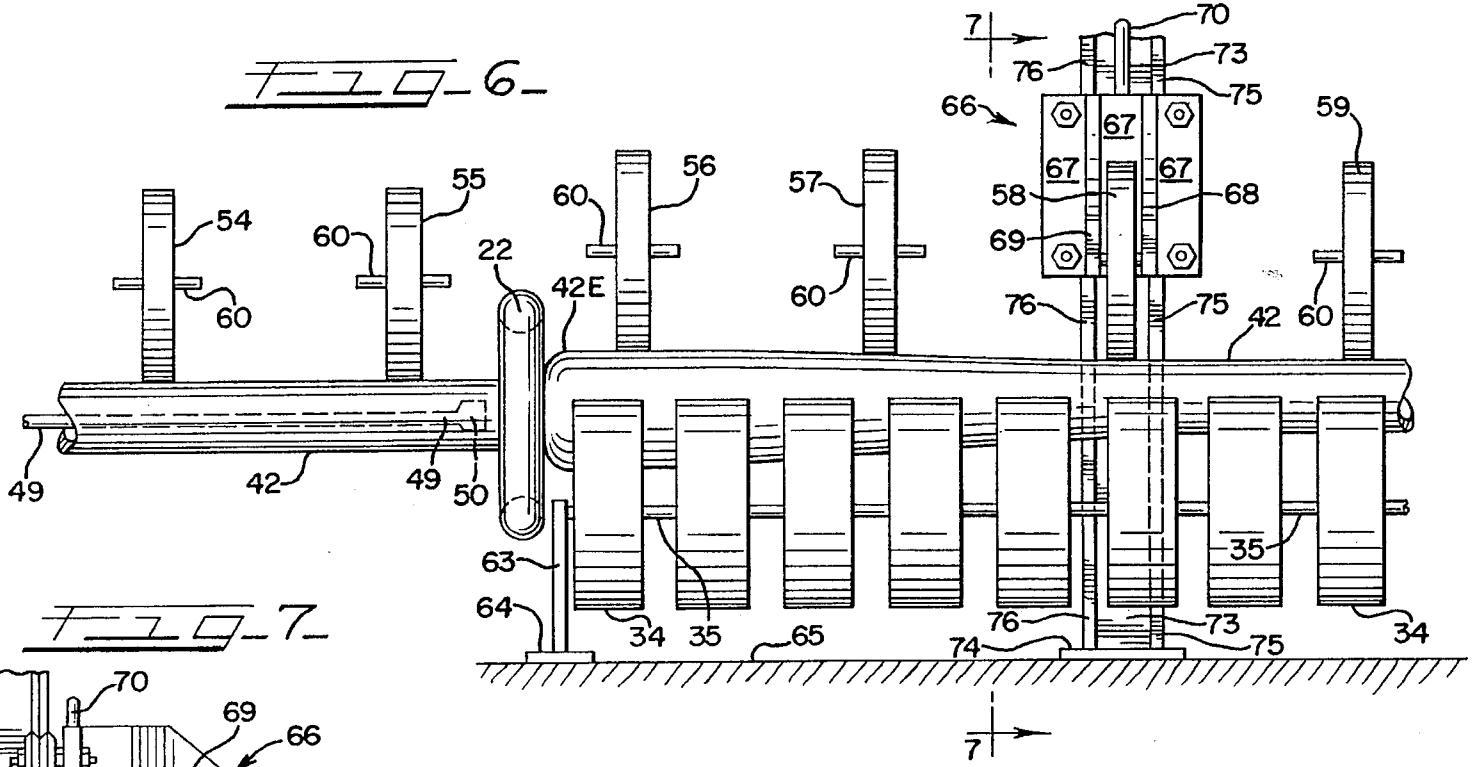
FIG. 6 is a simplified schematic left side elevational view similar to that of FIG. 2, showing the outlet portion of the coating apparatus with a thermally distorted pipe or tube rotating within the nesting grooves between rotating paired outlet rollers, and being maintained within the nesting grooves by a hold-down means.

FIGS. 5 and 6 illustrate the problem which is encountered in the apparatus of FIGS. 1 and 2, where the array of rollers is rotating the pipe or tube 42 as it is advanced longitudinally along the sequence of nesting grooves 53. Assuming a typical carbon steel pipe 42, and further assuming that the powdered metal which is sprayed from nozzle 50 within the induction heater 21 is a chrome alloy for imparting corrosion resistance to the inside surface of the pipe 42, the induction heating coil 22 will impose upon the carbon steel pipe 42 a temperature in the range of from about 1950° F. to 2300° F., or even more. This elevated temperature is necessary in order to cause the chrome alloy to melt and spread evenly along the inside surface of the rotating pipe 42 as it is moved longitudinally over the stationary spray head 50. Due to the sudden rise in temperature from ambient to the elevated temperature, the pipe 42 experiences rapid thermal expansion as it exits from the induction heating device 21.

This may be seen schematically in FIG. 5 where a pair of opposed right and left outlet rollers 32 and 34 are shown rotating with the conventional gap distance 52 between the rollers. The pipe 42, represented schematically by the dotted circular line, expands to a maximum circumferential dimension 42E because of the elevated temperature. Since the pipe is confined within the fixed geometric space of the nesting groove 53, it is constrained from expansion at the bottom position and it will expand outwardly at those portions of the pipe circumference which are above the rotating outlet rollers 32 and 34. This causes the rotating pipe 42 to assume an ovoid or egg-shaped configuration as shown by 42E, which represents the maximum circumference achieved by the rotating pipe.

It is to be realized that the thermal expansion and contraction of the pipe 42 does not appear in FIGS. 1 and 2. This is because the expansion and contraction of a hot pipe 42 is dimensionally small. However, compensation for such small dimensions is critical in eliminating the vibration problem which has been described hereinabove.

In point of fact, the maximum amount of growth in the diameter of the hot pipe will generally be only in the range of from about 0.020 to about 0.030 inch for nominal pipe sizes of from about 2 to 15 inches for carbon steel pipe. Yet, this small growth in pipe diameter can cause the vibration problem. The actual amount of expansion and contraction of the hot pipe will depend upon a number of parameters. Among the parameters which will influence the expansion and contraction of the metal pipe, are the size of the metal pipe, its wall thickness, the composition of the metal pipe, the composition of the powdered coating being fused to the inside surface of the metal pipe, the speed of rotation of the pipe (rpm), the speed or rate of travel of the metal pipe longitudinally along the sequence of nesting grooves, the heater temperature, and the room temperature.

FIG. 6 is a simplified schematic representation showing an apparatus configuration for dealing with the type of thermal expansion and contraction which is typically encountered in the thermal processing of a carbon steel pipe using an induction heater of high power input, such as 200 kilowatts, in a commercial coating operation. In this figure it will be noted that the coating material feed line 49 terminates in the spray nozzle 50 on the input side of the induction coil 22. This is the preferred location for the spray nozzle 50 in the coating apparatus. Additionally, the output rollers 32 and 34 have a surface width of six inches and they are spaced from adjacent rollers three or four inches in the region of high thermal expansion and contraction of the carbon steel pipe.

FIG. 6 shows that as the carbon steel pipe 42 is withdrawn from the 200 kW induction coil 22, a zone of rapid thermal expansion occurs over a very foreshortened distance, typically two or three inches, and that it occurs immediately upon discharge of the pipe from the induction coil. This means that the region of rapid thermal expansion reaches the point of maximum pipe circumference 42E before or as the expanded pipe enters the nesting groove between the first pair of adjacent rotating output rollers.

Figure 7:
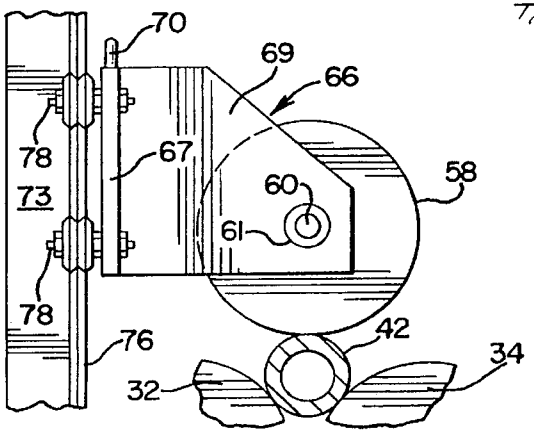
FIG. 7 is a simplified schematic left side elevational view of a hold-down device as seen along viewing line 7—7 in FIG. 6.

In order to compensate for the rapid thermal expansion of the hot pipe 42, a plurality of hold-down devices, which are exemplified by hold-down rollers 54, 55, 56, 57, 58, and 59, is provided. Each hold-down roller is mounted upon a rotatable shaft 60 which is journaled at each end in a bearing assembly 61, as shown in FIG. 7. An upstanding bearing block column 63 is provided for the rotating left outlet roller shaft 35, and similar bearing block structures may be provided for the other rotating roller shafts which are not shown in FIG. 6. The upstanding bearing block column 63 is mounted upon a footing plate 64 which is fixedly attached by means not shown to the concrete factory floor 65. In addition, a vertical support column 73 is shown mounted upon a footing plate 74 which is also attached conventionally to the concrete factory floor 65.

The vertical support column 73 has a hold-down carriage 66 for the hold-down roller 58 movably mounted upon it. This single hold-down carriage is shown, but each of the other hold-down rollers also is mounted within a hold-down carriage 66 which in turn is movably mounted upon an identical vertical support column 73 as shown for roller 58.

Figure 8:
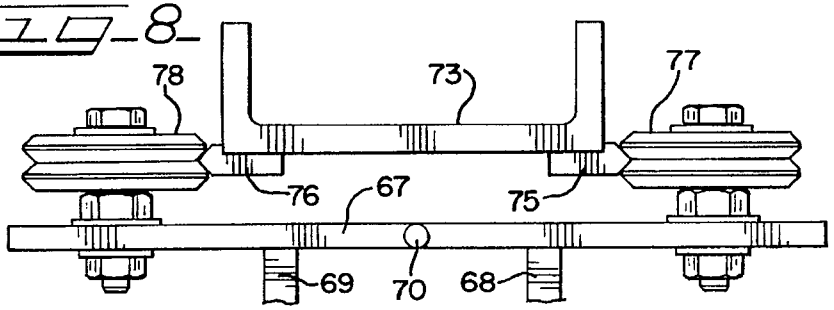
FIG. 8 is a simplified schematic partial plan view of the hold-down device of FIGS. 6 and 7 showing some elements in greater detail.

Thus, one preferred embodiment for a hold-down device in accordance with the present invention may be comprehended by viewing the FIGS. 6, 7, and 8 together. The hold-down device 66 has a hold-down roller 58 mounted upon a rotatable shaft 60 which is journaled within bearings 61. The bearings 61 are mounted within a carriage right side plate 68 and a carriage left side plate 69. The carriage side plates 68 and 69 are attached to a carriage back plate 67. A positioning means for positioning the carriage, and thereby moving the roller 58 in and out of tangential contact with the hot pipe 42, is provided by the motive means 70. Motive means 70 is shown as a piston rod activated by a pneumatic or hydraulic cylinder, not shown. The carriage positioning means 70 can also be a rotatable shaft with an outer helical screw thread, the shaft being driven by a reversible motor. Other means for moving the hold-down carriage 66 up and down for contacting the hold-down roller with the rotating pipe 42 may be conceived of by those skilled in the art.

FIG. 7 shows a left side elevational view of the hold-down roller 58 mounted in the carriage 66. The left side plate 69 is fixedly attached to the back plate 67. The roller shaft 60 is journaled in the bearing element 61. The carriage is movable up and down by means of the carriage positioning element or motive means 70. In order to move the carriage up and down on the supporting column 73, the carriage is provided with a plurality of right V-wheel assemblies 77 and left V-wheel assemblies 78, best seen in FIG. 8, which are in mating contact with a right side V-guide track 75 and a left side V-guide track 76 mounted on the front face of the supporting column 73, which has the shape of a channel member.

In this manner, each hold-down carriage 66 may be moved downwardly in order to provide a proper tangential contact of each individual hold-down roller 54–59 with the rotating pipe 42 at its specific axial location. Moreover, each hold-down roller may be adjusted independently at its location for the correct tangential contact. Thus, as seen in FIG. 6, hold-down rollers 54, 55, 58 and 59 are in contact with pipe 42 at tangential lines of contact where pipe 42 is at its normal diameter, whereas hold-down rollers 56 and 57 tangentially contact pipe 42 at two different diameters since the contacts are in the region of thermal expansion and contraction. Once the correct positioning of each hold-down roller is achieved for a given pipe size at a constant set of operating conditions, further adjustment is normally not required. Finally, each hold-down roller may be withdrawn vertically upward in order to move away from the inlet and outlet rollers 28, 30, 32 and 34 when necessary, as when the pipe 42 has been discharged from the internal coating apparatus and a new pipe must be loaded on the inlet rollers 28 and 30.

Although the rotating hold-down rollers 54–59 are shown to be axially aligned with the rollers 32 and 34 so that a tangential line contact is made with the rotating pipe 42 in the longitudinal or axial direction, other configurations are possible. It is within the scope of the present invention that the plurality of rotating hold-down rollers 54–59 may be oriented so that the rotatable shafts 60 may be transverse to the axis of the rotating pipe. In such an embodiment, the hold-down rollers will rotate in the direction in which the hot pipe 42 is advancing, and they will generally be in a point-like tangential contact with pipe 42. In a further embodiment, the rollers 54–59 may be replaced by spherical rollers which have the configuration of a furniture caster. Such spherical hold-down rollers would have a point tangential contact and would be freely rotatable in all directions. Thus, such spherical rollers would rotate in a direction which is caused by a force vector resulting from the force of rotation and the force of the axial advance of the rotating pipe 42. Other modifications to achieve an effective hold-down device may be conceived of by those skilled in the art.

FIG. 6 shows two hold-down rollers on the inlet side of the heating element 22, and four hold-down rollers on the outlet side of the heater 22, but this should not be construed to so limit the present invention. Operations have been conducted with three hold-down rollers on each side of the heating unit, and the preferred embodiment is to employ four hold-down rollers on each side. The hold-down rollers which have been used have been six inches in diameter with a surface width of one-half inch. The hold-down rollers 55 and 56 which are nearest to the heater have been operated at a distance of eight inches away from the heating element 22. The other rollers on each side of the heating element are spaced at a distance of three feet between the rollers. It must be realized, however, that these dimensions are not limiting, since the roller dimensions and their spacing will vary with the amount of thermal expansion and contraction. As noted above, the amount of thermal expansion and contraction will be affected by a great many parameters.

Accordingly, although the various aspects of the present invention have been described with preferred embodiments illustrated herein, it is to be understood that modifications and variations may be resorted to without departing from the spirit and scope of this invention. As those skilled in the art will readily understand, such modifications and variations are considered to be within the purview and the scope of the appended claims.

The invention claimed:

1. A method for processing a metal cylindrical body of

2–15 inches in diameter having a wall that expands from a first diameter at an inlet side of a heating means to a larger second diameter at an outlet side of the heating means, said method comprising:

supporting the metal cylindrical body and applying a rotating force to the cylindrical body with rotating support rollers beneath the cylindrical body on the inlet side of the heating means;

pushing with a pusher means on a rearward end of the cylindrical body which is rotating on the inlet rollers and advancing a forward end of the cylindrical body into and through a heating means;

heating the wall of the cylindrical body to at least 1,950° F. in the heating means to expand to a larger diameter than the first diameter;

supporting the expanded larger diameter portion of the cylindrical body on rotating outlet rollers that support and apply a force to rotate the larger diameter, cylindrical body portion leaving the heating means;

exerting a downward force on the first diameter of the cylindrical body at the inlet side of the heating means at first and second spaced locations on the inlet side of the cylindrical body by at least two, spaced apart, hold-down rollers to hold the cylindrical body down onto the inlet rollers at a first distance spaced radially outward of the body's centerline to reduce vibration and to hold the cylindrical body onto the inlet rollers; and exerting a downward force on the expanded larger diameter portion of the cylindrical body by at least, two spaced apart, hold-down rollers at spaced locations on the outlet side of the cylindrical body at a second distance on the cylindrical body spaced radially outward of the first and second hold-down rollers on the inlet side of the heating means, thereby holding the entire cylindrical body from bouncing from the inlet rollers and the outlet rollers as the pusher means pushes the cylindrical body across the inlet side of the heating means and through the heating means to emerge therefrom at the larger second diameter.

2. A method in accordance with claim 1 including the step of advancing the inlet and outlet hold-down rollers into tangential contact with the cylindrical body after it has been placed on the rotating support rollers and for withdrawing the inlet and outlet hold-down rollers from the cylindrical body after it has been heated by the heating means.

3. A method in accordance with claim 2 including the step of applying a coating to an internal surface of the rotating, cylindrical body as it advances through the heating means.

4. In a coating apparatus for holding and rotating a tubular, hollow, cylindrical body of between 2 to 15 inches in diameter having a radial wall and an interior surface to which a material is to be fused when heated at a location intermediate ends of the cylindrical body, the combination comprising:

heating means having an inlet and an outlet and for heating a cylindrical body passing therethrough to at least 1,950° F. and causing an expansion of the diameter of the cylindrical body from a first diameter at an inlet side of the heating means to a larger second diameter when leaving the heating means;

a plurality of paired inlet rollers adjacent the inlet side of the heating means and supporting the cylindrical body for rotation as it passes into the heating means;

a plurality of paired outlet rollers adjacent the outlet side of the heating means and supporting the cylindrical body for rotation as a heated and expanded portion of the cylindrical body leaves the heating means and contracts in diameter;

a nesting groove above each set of paired rollers and between adjacent portions of upper surfaces on each set of paired rollers;

motive means for rotating said inlet and outlet rollers to thereby rotate the cylindrical body within the nesting grooves of adjacent pairs of inlet and outlet rollers;

an axial advancing means including a pusher for longitudinally pushing the rotating cylindrical body through said heating means and sequentially along and within the nesting grooves of adjacent pairs of inlet and outlet rollers;

means for coating the inside of the tubular, hollow, cylindrical body with a material to be fused to the interior heated surface of the cylindrical body;

first and second spaced apart inlet hold-down rollers on the inlet side of the heater means positioned at a first location to engage the smaller, first diameter portion of the cylindrical body and to hold the cylindrical body within the nesting grooves of adjacent pairs of rollers as the cylindrical body rotates and is pushed by the pusher along the paired inlet rollers; and first and second spaced apart outlet hold-down rollers on the outlet side of the heater means positioned on the outlet side of the heater means engaging the larger second diameter portion of the cylindrical body at spaced locations and holding the larger diameter portion down against the lower, rotating, paired outlet rollers with the latter rotating the larger diameter portion of the expanded cylindrical body, the respective first and second inlet and outlet hold-down rollers holding the cylindrical body against vibrating and bouncing off the rotating paired inlet and outlet rollers.

5. An apparatus in accordance with claim 4 including means for advancing the inlet hold-down rollers and the outlet hold-down rollers for tangentially contacting said cylindrical body and for withdrawing said hold-down rollers from said cylindrical body.

6. An apparatus in accordance with claim 4 including means for applying a coating to an internal surface of the rotating cylindrical body as it advances through the heating means.

* * * * *